US005183089A

United States Patent [19]

Norlander et al.

[11] Patent Number: 5,183,089

[45] Date of Patent: Feb. 2, 1993

[54] CHIPPER KNIFE ASSEMBLY

[75] Inventors: Norman E. Norlander, Puyallup; Ralph A. Thompson, Auburn, both of Wash.

[73] Assignee: Weyerhaeuser Company, Tacoma, Wash.

[21] Appl. No.: 827,127

[22] Filed: Jan. 28, 1992

[51] Int. Cl.[5] ..... B26D 1/12

[52] U.S. Cl. ..... 144/231; 83/842; 144/218; 144/241; 144/374; 407/46; 407/49

[58] Field of Search ..... 407/41, 46, 49, 87, 407/90, 101, 5, 6; 144/218, 230, 231, 233, 235, 236, 241, 374; 83/842

[56] References Cited

U.S. PATENT DOCUMENTS

| | | | |
|---|---|---|---|
| 867,980 | 10/1907 | Krieger | 83/842 |
| 3,356,114 | 12/1967 | Noel | 144/230 |
| 3,487,865 | 1/1970 | Chapman et al. | 144/237 |
| 4,151,869 | 5/1979 | Halloran et al. | 407/46 |
| 4,667,713 | 5/1987 | Wright | 144/231 |
| 4,889,025 | 12/1989 | Collett | 144/241 |

*Primary Examiner*—W. Donald Bray

[57] ABSTRACT

A knife assembly for a chipping canter has a knife holder which is mounted on a rotatable chipper head. Along an upper edge of the knife holder is a receiving and holding portion in which is removably mounted a readily replaceable chipper knife.

1 Claim, 3 Drawing Sheets

60
CANT PROFILE OUTLINE
18
18
8
8
8
2
2
2
2
18
34
12
12

CHIPPER KNIFE ASSEMBLY

BACKGROUND OF THE INVENTION

The present invention relates to a knife assembly for a chipping canter or similar small log sawmill device which may be readily and simply removed for maintenance or replacement. The knife assembly is especially well adapted for use on chipping canters having a plurality of knife retaining rotatable segments mounted on a common shaft so as to define a generally cylindrical chipper head when in operation. At the present time approximately half of the saw logs in the United States and Canada are processed through primary breakdown devices including a chipper as an integral part. These chippers create flat surfaces on one or more sides of the log to simplify downstream processing. The portions of the log that would formerly have been removed as slabs are thereby converted into saleable pulp chips. Such devices are frequently called canters since the log is usually configured by the chippers so that it is converted into one or more cants of predetermined dimensions after subsequent primary sawing. A cant is a sawn or otherwise processed piece of wood of generally rectangular cross section intended for further processing into boards or dimension lumber.

The most popular chipping canters are configured to have a plurality of individual segments stacked one adjacent another on a common shaft. Each segment normally has two replaceable peripheral cutter knives. Adjacent heads on a given shaft are normally rotated so that the cutter knives are displaced by 90°. Knives are retained in notches on the periphery of the segment by a heavy dog fastened with a single bolt.

One device using chippers of this type is sold as the Chip-N-Saw® chipping canter/primary log breakdown unit. Chip-N-Saw is a registered trademark of Kockums CanCar, a Hawker Siddeley company of Vancouver, B.C.

The knives of the chipping canter of the type described above have a cutting edge approximately 50 mm in length and are made of a single piece of steel. The top-to-bottom dimension of these knives changes as they are ground for sharpening. In order to compensate for this, before replacement on the machine, they are placed in a jig and a shim of babbit metal is poured adjacent the bottom surface. In this manner a constant cutting radius can be maintained. In some positions on a typical installation the knives are routinely replaced as frequently as every four hours. Depending on the maximum log size to be processed through the machinery, from 20 to 50 chipper segments employing twice this many knives are used. Knife replacement and maintenance forms a major item of operating expense. After grinding for resharpening, the babbitt shim must be stripped from the base. A number of knives are placed side by side in a gib and shimmed or otherwise adjusted to bring the edges to a common height. Then a contoured grinding wheel traverses the knives to resharpen them. Each individual knife must them be removed and rebabbitted before it can again be installed on the machine. The grinding wheels themselves represent a significant expense. Their life is relatively short since they must frequently be dressed to maintain a precise and complex edge configuration.

Others have in the past looked at chipping canters with an object of simplifying knife maintenance. One such effort is described in U.S. Pat. No. 3,356,114 to Noel. Here the knife is a simple arcuate or crescentic-shaped blade which extends the full length of an elongated cylindrical chipper head. This blade is frictionally held in place in an arcuate seat on the chipper head by a dog and jib arrangement. Normally the base will be babbitted or otherwise shimmed to ensure a constant cutting radius. Another example of a chipping knife assembly that was designed with maintainability in mind is that disclosed in U.S. Pat. No. 4,667,713 to Wright. In this patent a multi-piece knife assembly includes a separate slidable knife assembly mounted on a removable knife holder. The slidable and removable knife member can be sharpened and then adjusted when it is replaced in its knife holder for precision chipping. This particular design is relatively complex and is expensive to manufacture. When this chipping knife assembly is in use it is one that has many interconnected parts and therefore is susceptible to breakage plus being difficult to maintain proper alignment during continued operations. This particular type of chipping knife assembly resembles somewhat those complex saw teeth structures used in saws. The following U.S. patents are representative of some of the earlier variations in this generic concept: Woodcook, U.S. Pat. No. 1,356,682; Brown, U.S. Pat. No. 1,140,021; Freas, U.S. Pat. No. 1,831,705; and Charlton, U.S. Pat. No. 2,117,147. These and many subsequent similar patents are primarily directed to minor variations in tooth configuration to ensure tightness and stability during operation.

There has been a long-felt need within the sawmilling industry for a chipping canter knife assembly which has readily replaceable individual knife members appropriately incorporated into the overall assembly and which is relatively simple, economical and readily maintained. These needs have now been fulfilled by the knife assembly of the present invention.

SUMMARY OF THE INVENTION

Briefly stated the present invention is practiced in one form by a knife assembly for a chipping canter or similar device. The assembly has a knife holder which is mountable on a chipper head segment in similar fashion to prior art chipper knives. A flat basal surface and a flat upwardly extending rear surface are sized to fit within corresponding receiving surfaces located on the head segment. Along an upper edge of the knife holder is a receiving and holding portion which likewise has at least two substantially flat surfaces. Adapted to be removably mounted within the receiving and holding portion is a replaceable chipper knife which likewise has relatively flat basal and rear surfaces and a bolting means that extends through the top portion of the knife holder to engage a threaded portion within the rear surface of the replaceable knife.

DESCRIPTION OF THE PREFERRED EMBODIMENT

Figure 1:
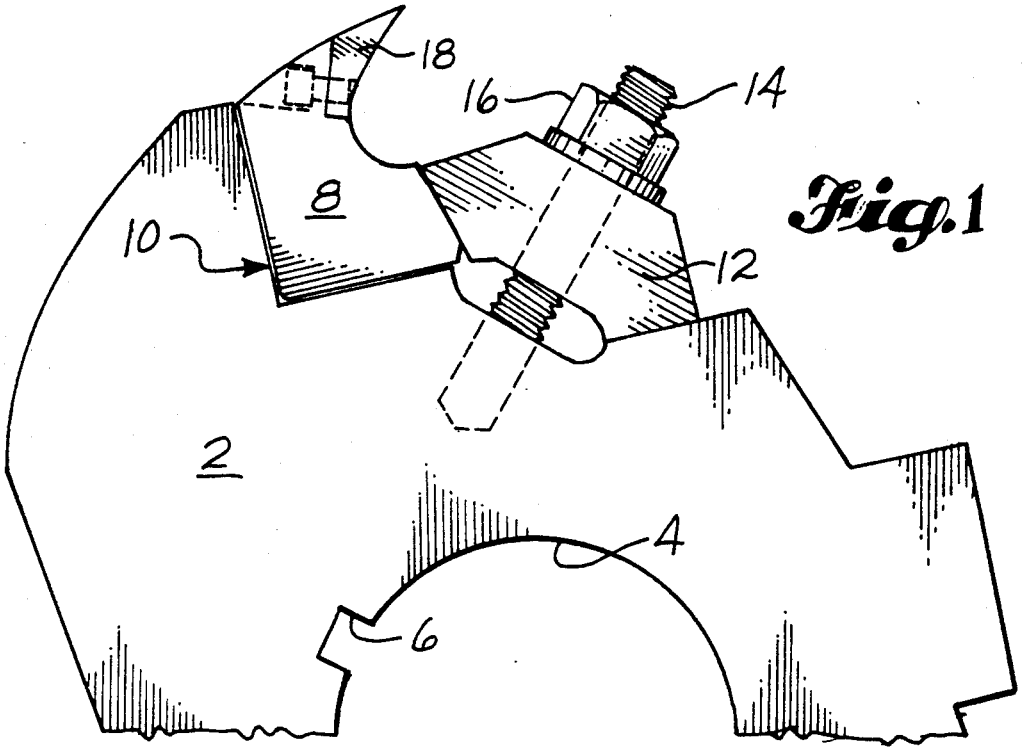
FIG. 1 illustrates a portion of a complete rotatable knife assembly having the present invention.
Figure 2:
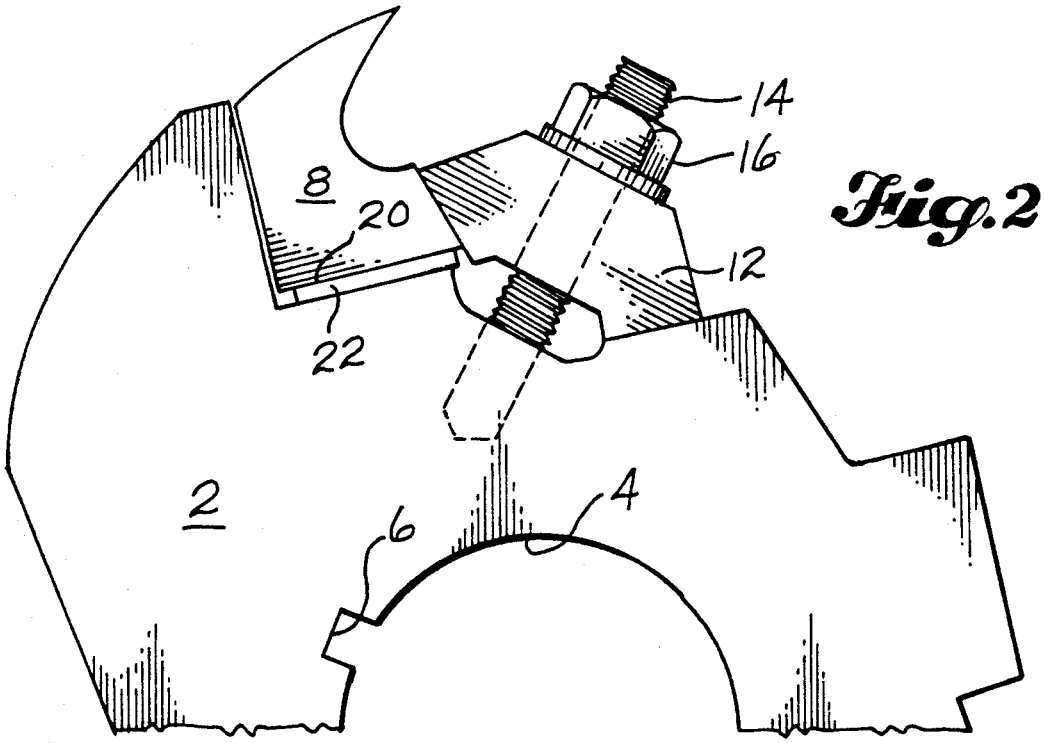
FIG. 2 is similar to FIG. 1 but shows a typical prior art configuration for the removable knife.

Turning to FIGS. 1 and 2, a typical construction and operation of the present chipper knife assembly will be better appreciated with an understanding of how prior art chipper knives are used and maintained. A chipper head segment 2 has a substantially circular opening at the center indicated as 4 with a key way at 6. Normally a plurality of chipper head segments will be mounted on a rotatable shaft (not shown) and locked in place. These chipper head segments with their knives will form a chipping station within a log breakdown device. Normally several heads will be stacked on the rotatable shaft with each being rotated 90° with respect to its adjacent head. Normally a pair of knife holders, with one being indicated at 8 in FIG. 1 are mounted on the periphery. Each knife holder is held tightly in place in its seat generally indicated at 10 by dogs 12 which are held in position by a stud 14 threaded into segment 2 and extending through dog 12 whereby a nut and washer combination 16 then functions to hold the dog 12 in place.

As illustrated in FIG. 1 the knife holder 8 is removable from its normal position on the periphery of the chipper head segment. The cross-sectional shape of knife holder 8 is substantially similar to those used in the prior art where, as illustrated in FIG. 2, the uppermost outwardly extending edge of the knife holder forms the knife edge which cuts the chips during operation. A significant difference as illustrated in FIG. 1 is that a separate replaceable chipper knife 18 is mounted on the upper edge of knife holder 8 and becomes a separate, replaceable knife tip.

Another difference between the knife assembly of the present invention and typical state-of-the-art knife assemblies, as illustrated in FIG. 2 is that the present invention eliminates the need for a babbitting material being affixed to the bottom surface of the knife holder. In FIG. 2 a bottom surface is illustrated at 20 while the babbitting material is illustrated at 22. When the knife assemblies that are used today must be removed for sharpening, each time the knife edge is sharpened the assembly must be rebabbitted so that the relative dimensions are maintained and chipping precision likewise maintained. A significant advantage of the present invention is that by using separate, replaceable knife tips, the babbitting material can completely be eliminated.

As will be well appreciated by those skilled in the art, when removing the entire knife assembly the bolt on the stud must be loosened which oftentimes is a difficult effort because it is torqued down so tightly. However, each time a knife must be removed for sharpening or other maintenance, the dogs must be removed to remove the entire knife assembly not only for sharpening but, as previously pointed out, for rebabbitting. With the present invention, not only is there no babbitting material required but the knife holder will normally simply be left in place when the separate, replaceable knife tips are removed.

Figure 3:
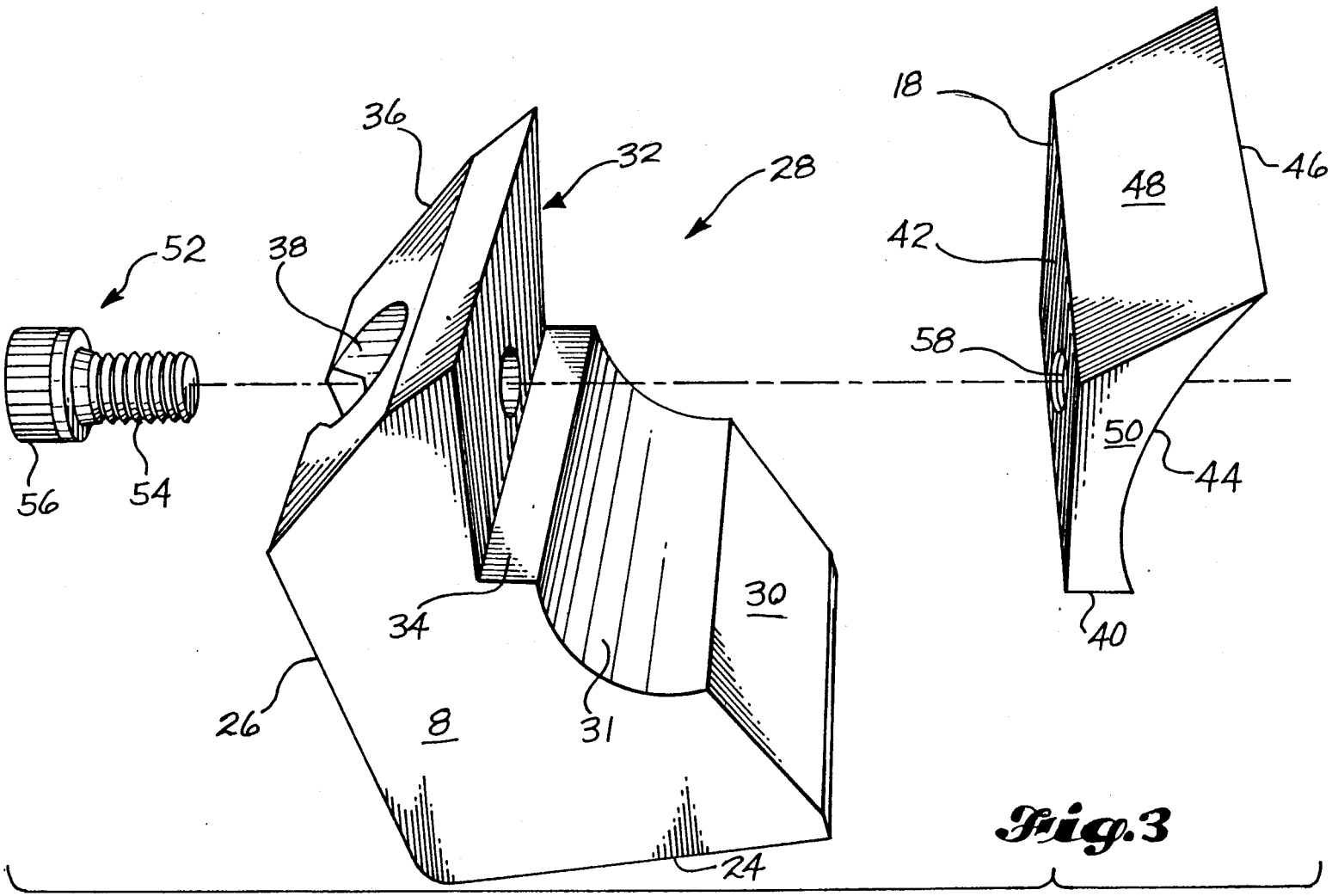
FIG. 3 is an exploded view showing in perspective a removable knife holder with its removable and replaceable chipper knife relative to its mounting surfaces on the knife holder.

Turning now to FIG. 3 the details of the knife assembly of the present invention will be described. As previously noted, knife holder 8 has a shape substantially similar to prior art chipper knife assemblies having a base or basal portion 24 and a rear surface 26 angularly disposed with respect to each other for engaging seat 10 on the periphery of segment 2. The benefit is the fact that no special allowance is needed for affixing babbitting material to the basal surface 24. A front surface indicated generally at 28 is comprised of a hold down surface 30 for cooperating with dogs 12, a concave arcuately shaped portion 31, and a portion 32 for receiving and holding in place the replaceable knife means 18. Extending rearwardly from the uppermost edge of the receiving and holding means 34 is a generally downwardly inclined top surface 36. Located within surface 36 is an aperture 38 extending through the top portion of knife holder 8. The lowermost edge on surface 36 forms the top edge of the rear surface 26 and is structured so as to be adjacent a peripheral edge on head segment 2. As will be apparent, the purpose for this is to remove any gaps where debris could collect.

The replaceable knife 18 has a basal portion 40 and a rear surface 42 angularly disposed with respect to each other for engaging the receiving and holding means 34 within knife holder 8. Knife 18 has a concave arcuate front surface 44 terminating along a top edge 46 which is the chipping knife edge. Extending rearwardly from top knife edge 46 and in a downwardly inclined direction is top surface 48 which terminates at the uppermost top edge of receiving and holding means 34. A pair of laterally opposed side edges, each indicated at 50, complete the construction of each individual replaceable knife 18. It is pointed out that the angular orientations of the exposed surfaces are substantially similar to those within state-of-the-art knife assemblies for similar applications. Serving to hold each individual knife 18 within its respective receiving and holding means 34 is an appropriately sized bolt 52 having a threaded end 54 and a turnable head end 56. Machined into rear surface 42 in line with aperture 38 are a set of internal threads 58 which cooperate and receive the bolt 52 as it is turned to draw knife 18 down into receiving and holding means 34. Once tightened down bolt 52 functions to hold knife 18 firmly in place during operation when it is subjected to lateral forces.

Head 56 has a seat within the aperture so that as it is turned to draw knife 18 it will be firmly seated in place with the base and rear surfaces 40, 42 resting tightly against the receiving and holding means 34 within the knife holder 8. For the sake of convenience a hexagonal opening is provided in the rear of head 56 for the insertion therein of an Allen wrench which is a convenient means for tightening and releasing bolts 52.

Figure 4:
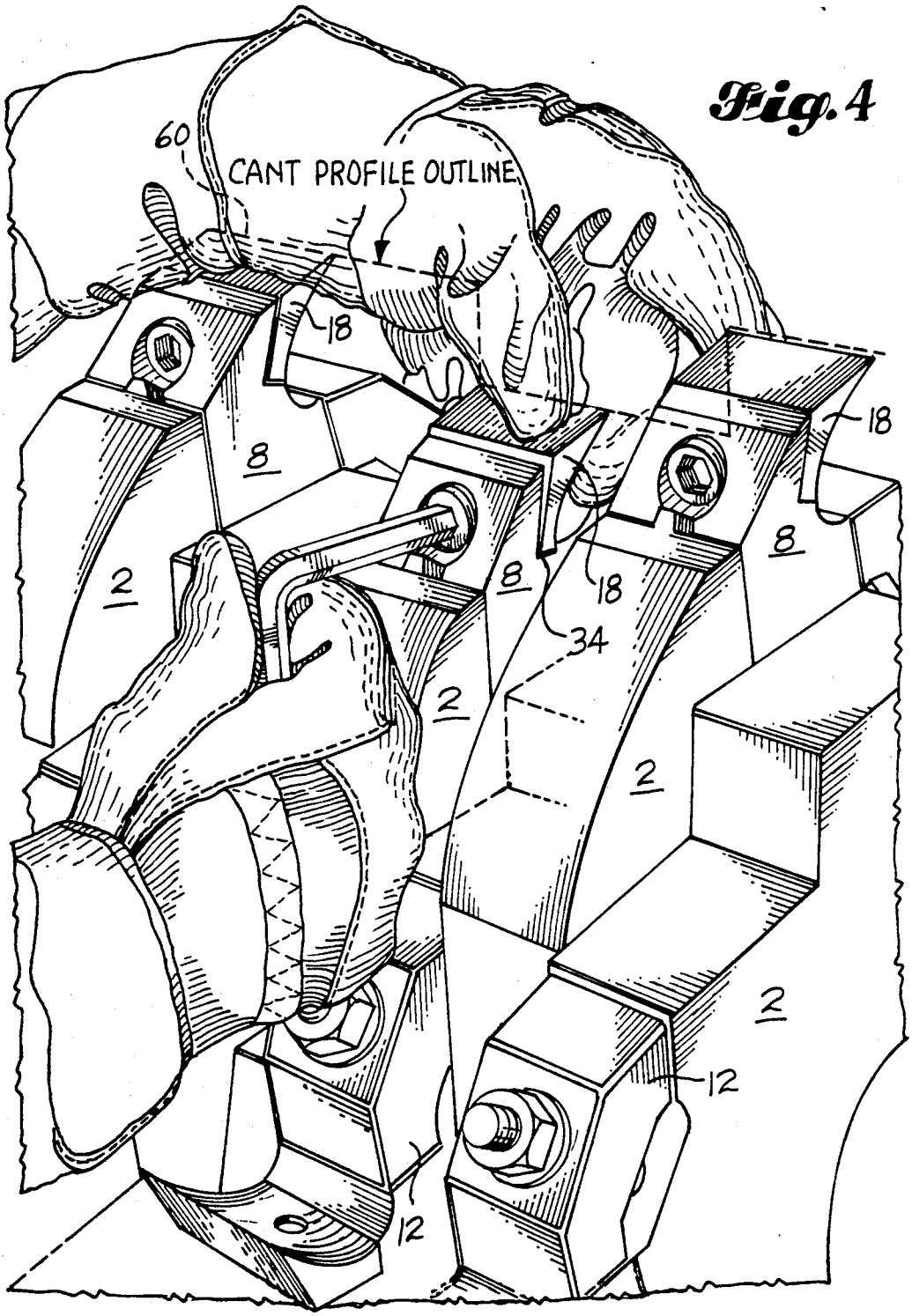
FIG. 4 is another perspective view showing a plurality of chipper head segments mounted on a rotatable shaft with a worker manipulating a bolt that affixes the replaceable chipper knife within its receiving and holding portion in the knife holder.

Turning now to FIG. 4 a plurality of chipper head segments are shown along with an exemplary orientation for several of the replaceable knives as they are seated within their respective knife holders. Also illustrated is the different dimensioning possible with respect to a cant profile outline indicated at 60. As illustrated, the radial heights of selected top knife edges 46 vary according to the profile to be machined on a passing work piece. Being illustrated in FIG. 4 is a workman placing a new replaceable knife 18 in the receiving and holding means 34 in the respective knife holder. It is a simple matter for the workman to hold in one hand the knife tip while manipulating the Allen wrench with the other to draw the knife tip securely into the receiving and holding means.

Each of the replaceable, separate knife tips 18 can be constructed from high quality knife alloys while the other components can be comprised of relatively inexpensive steel materials.

Thus, what has been described in an improvement in a knife assembly for a chipping canter, one which allows the retention of present cutting geometry and knife shape for good chip quality and recovery. Similarly by using separate and replaceable knife tips a significant amount of reduced maintenance is obtained since knives are not resharpened and there is no babbitting of the knife holders needed. Knife height is maintained at a very accurate precision and, therefore, the cant being produced will be one with good precise lumber dimensions. By so reducing the continuous need for changing of knives and sharpening prior to replacement, a significant cost reduction is obtained by reducing the labor required and capital equipment costs for grinding knives and the like.

Thus, what has been described is a significant advance in the chipping knife art and many modifications may occur to those with ordinary skill in the art. All such modifications and changes are intended to be included within the scope of the appended claims.

We claim:

1. A knife assembly for a chipping canter or similar device which comprises a removable knife holder means, a replaceable chipper knife means seated on said holder, a chipper head segment having at least one knife holder seat located on its periphery;

the knife holder having basal and rear surfaces angularly disposed with respect to each other for engaging the holder seat, a front surface having three portions including a hold down surface, a concave arcuately shaped portion, and a portion for receiving and holding in place the replaceable knife means, said last portion having an opening therein to accommodate a portion of the holding means;

the replaceable chipper knife having basal and rear surfaces angularly disposed with respect to each other for engaging the receiving and holding portion in the knife holder, a front surface with a concave arcuate orientation terminating at a top knife edge and terminating along the bottom edge substantially in line with the arcuately shaped portion on the front surface of the knife holder, and a top surface extending rearwardly from the knife edge to meet the top edge of the rear surface;

the replaceable chipper knife holding means further including a bolting means extending through the top portion of the knife holder to engage a threaded portion within the rear surface of the knife, said bolting means being seated, when tightened, within the upper portion of the rear surface.

* * * * *